US008718310B2

(12) United States Patent
Adams

(10) Patent No.: US 8,718,310 B2
(45) **Date of Patent: *May 6, 2014**

(54) MULTIPLE APERTURE SPEAKER ASSEMBLY

(75) Inventor: Michael Adams, Vista, CA (US)

(73) Assignee: QSC Holdings, Inc., Costa Mesa, CA (US)

( * ) Notice: Subject to any disclaimer, the term of this patent is extended or adjusted under 35 U.S.C. 154(b) by 106 days.

This patent is subject to a terminal disclaimer.

(21) Appl. No.: 13/118,318

(22) Filed: May 27, 2011

(65) Prior Publication Data

US 2011/0274306 A1 Nov. 10, 2011

Related U.S. Application Data

(63) Continuation-in-part of application No. 13/104,825, filed on May 10, 2011, which is a continuation-in-part of application No. 11/674,458, filed on Feb. 13, 2007, now Pat. No. 7,953,238, which is a continuation of application No. 10/274,627, filed on Oct. 18, 2002, now Pat. No. 7,177,437.

(60) Provisional application No. 60/345,279, filed on Oct. 19, 2001.

(51) Int. Cl.
*H04R 25/00* (2006.01)

(52) U.S. Cl.
USPC ..... 381/340; 381/337; 381/339

(58) Field of Classification Search
USPC ..... 381/335–343, 152, 182, 186, 351; 181/144, 148, 152, 159, 160
See application file for complete search history.

(56) References Cited

U.S. PATENT DOCUMENTS 2,001,089 A 5/1935 Blattner
2,135,610 A 11/1938 Wente (Continued)

FOREIGN PATENT DOCUMENTS

CN 2254257 5/1997
DE 968490 2/1958

(Continued)

OTHER PUBLICATIONS

Breshears, Vance and Heinz Ralph, "An Integrated Three-Way Constant Directivity Speaker Array," presented at the 101st AES Convention, Los Angeles, California, Nov. 8-11, 1996.

(Continued)

*Primary Examiner* — Suhan Ni
(74) *Attorney, Agent, or Firm* — Knobbe, Martens, Olson & Bear, LLP

(57) ABSTRACT

Methods and apparatus are provided for waveguide structures and speaker assemblies. In one embodiment, a waveguide may include an input aperture configured to receive a sound signal from a sound source, and a plurality of isolated sound paths having substantially equal path lengths. Each isolated sound path may be formed within a housing of the waveguide and formed with a curved path to reduce the depth of the waveguide. The waveguide may include a plurality of plugs, wherein each plug divides an output of one of the isolated sound paths into a plurality of output sound paths and defines a plurality of output apertures of the waveguide. Each output sound path is characterized by a reduced width relative to the output of the isolated sound path, the plurality of output apertures configured to output a combined sound signal based, at least in part, on the plurality of sound signals.

26 Claims, 13 Drawing Sheets

(56) References Cited

U.S. PATENT DOCUMENTS

| | | | |
|---|---|---|---|
| 2,203,875 | A | 6/1940 | Olson |
| 2,537,141 | A | 1/1951 | Klipsch |
| 3,852,529 | A | 12/1974 | Schafft |
| 3,972,385 | A | 8/1976 | Hino et al. |
| 4,040,503 | A | 8/1977 | Hino et al. |
| 4,071,112 | A | 1/1978 | Keele, Jr. |
| 4,210,223 | A | 7/1980 | Gillum et al. |
| 4,325,456 | A | 4/1982 | Ureda |
| 4,344,504 | A | 8/1982 | Howze |
| 4,390,078 | A | 6/1983 | Howze et al. |
| 4,685,532 | A | 8/1987 | Gunness |
| 4,718,517 | A | 1/1988 | Carlson |
| 4,776,428 | A | 10/1988 | Belisle |
| 4,836,327 | A | 6/1989 | Andrews et al. |
| 4,893,343 | A | 1/1990 | Bader |
| 4,975,965 | A | 12/1990 | Adamson |
| 5,117,462 | A | 5/1992 | Bie |
| 5,163,167 | A | 11/1992 | Heil |
| 5,351,220 | A | 9/1994 | Noselli |
| 5,524,062 | A | 6/1996 | Oh |
| 5,900,593 | A | 5/1999 | Adamson |
| 5,970,158 | A | 10/1999 | Beltran |
| 6,112,847 | A | 9/2000 | Lehman |
| 6,343,133 | B1 | 1/2002 | Adamson |
| 6,394,223 | B1 | 5/2002 | Lehman |
| 6,530,451 | B2 | 3/2003 | Noselli |
| 6,581,719 | B2 | 6/2003 | Adamson |
| 6,628,796 | B2 | 9/2003 | Adamson |
| 6,668,969 | B2 | 12/2003 | Meyer et al. |
| 6,744,899 | B1 | 6/2004 | Grunberg |
| 7,177,437 | B1 | 2/2007 | Adams |
| 7,278,513 | B2 | 10/2007 | Brawley, Jr. |
| 7,650,006 | B2 | 1/2010 | Isotalo |
| 7,953,238 | B1 | 5/2011 | Adams |
| 2001/0023792 | A1 | 9/2001 | Noselli |
| 2002/0114482 | A1 | 8/2002 | Adamson |
| 2003/0068058 | A1 | 4/2003 | Noselli |
| 2003/0132056 | A1 | 7/2003 | Meyer et al. |
| 2003/0188920 | A1 | 10/2003 | Brawley, Jr. |
| 2004/0218773 | A1 | 11/2004 | Andrews |
| 2007/0080019 | A1 | 4/2007 | Kubota |
| 2008/0264717 | A1 | 10/2008 | Onishi |
| 2011/0211720 | A1 | 9/2011 | Adams |

FOREIGN PATENT DOCUMENTS

| | | | |
|---|---|---|---|
| GB | 327145 | | 3/1930 |
| GB | 495594 | | 11/1938 |
| GB | 1463192 | | 2/1977 |
| GB | 2316846 | | 3/1998 |
| GB | 2 458 275 | | 9/2009 |
| GR | 1003008 | B | 11/1998 |
| JP | 58130693 | A2 | 8/1983 |
| JP | 09135489 | A2 | 5/1997 |
| JP | 10-66183 | | 3/2010 |
| WO | WO 02/25991 | | 3/2002 |
| WO | WO 02/056293 | | 7/2002 |

OTHER PUBLICATIONS

Button, Doug, "High Frequency Components for High Output Articulated Line Arrays," Audio Engineering Society Convention Paper, presented at the 113$^{th}$ Convention, Los Angeles, California, Oct. 5-8, 2002.

Meyer Sound, "Line Arrays: Theory, Fact and Myth", Technical Paper, Copyright 2002.

Meyer Sound, "The Design and Performance of the REM Ribbon Emulation Manifold Waveguide," Technical Paper, Copyright 2005.

Urban, Marcel and Bauman, Paul, "Wavefront Sculpture Technology," *J. Audio Eng. Soc.*, vol. 51, No. 10, Oct. 2003.

International Search Report and Written Opinion dated Aug. 16, 2012 for corresponding PCT Application No. PCT/US2012/039206.

Y-Axis Technical Brochure, "Line Array Elements, etc.", Adamson, 6 pages.

Technical Specifications, Y-Axis, Adamson Systems Engineering, Inc. 2 pages; 09-01.

"Line Arrays versus line Source arrays" *L'Acoustica*, Jan. 2001, pp. 1-14.

Audio Engineering Society Convention Paper, Presented at the 110$^{th}$ Convention, May 12-15, 2001 Amsterdam, The Netherlands, pp. 1-12.

John Eargle, David Scheirman and Mark Ureda, JBL's Vertical Technology™: Achieving Optimum Line Array Performance Through Predictive Analysis, Unique Acoustic Elements and a New Loudspeaker System, JBL Professional White Paper, Sep. 2000—Audio Engineering Society Convention, pp. 1-15.

"Molding Vinyl Ester Engineered Structural Composite (ESC) Molding Compounds", Quantum Composites®, Inc. Subsidiary of Premix, Inc. Reprinted from *Plastics Engineering*, Feb. 1989.

"Outline wishes to state that its "Butterfly" series line array is an original proprietary product", Outline s.n.c., Sep. 19, 2003, 25 pp.

Urban, Heil and Bauman, "Wavefront Sculpture Technology", *Acoustic Engineering Society*, Reprint #5488, 2001.

U.S. Appl. No. 13/104,825, filed May 10, 2011, Adams, 2011-0211720.

MULTIPLE APERTURE SPEAKER ASSEMBLY

CROSS-REFERENCE TO RELATED APPLICATIONS

This application is a continuation-in-part of U.S. patent application Ser. No. 13/104,825, filed May 10, 2011 and a continuation-in part of U.S. patent application Ser. No. 11/674,458 filed Feb. 13, 2007, now U.S. Pat. No. 7,953,238 and entitled "Multiple Aperture Diffraction Device," which is a continuation of U.S. patent application Ser. No. 10/274,627 filed Oct. 18, 2002, now U.S. Pat. No. 7,177,437 and entitled "Multiple Aperture Diffraction Device," which claims priority to U.S. Provisional Application No. 60/345,279 filed Oct. 19, 2001, the disclosures of which are hereby incorporated by reference.

BACKGROUND

1. Field

The present disclosure relates to sound technology in general and, in particular, relates to waveguides and speaker assemblies having multiple apertures.

2. Description of Related Art

Speakers convert electrical signals to sound waves that allow listeners to enjoy amplified sounds. One of the factors that determines the quality of the speaker-generated sound heard by the listener is the sound pressure level (SPL). The quality of the SPL generally depends on the size of the speaker relative to the distance between the speaker and the listener. Generally, a larger distance requires a larger speaker size. Obviously, there is a practical limit on how large a speaker can be made. For example, an overly large speaker may create difficulties in transporting or mounting. Furthermore, a correspondingly large driving element needed to drive a large speaker may require an impractical amount of power.

To circumvent such drawbacks, an array of smaller sized speakers can be used to achieve similar acoustic results. As is generally understood, sound waves from each individual smaller sized speaker may combine to yield a combined sound wave that behaves similar to a sound wave emanating from a single large speaker.

Effective and coherent combination of sound waves may be achieved when certain wave related parameters are satisfied. One such requirement is that individual waves emanating from the smaller sized speakers exhibit a substantially fixed phase difference relative to waves output from the other smaller sized speakers. When all of the smaller sized speakers in a linear arrangement are driven substantially in phase (substantially zero phase difference), a resulting combined wave propagates in a direction normal to a line defined by the speakers. A substantially fixed non-zero phase difference among the individual waves results in a combined wave that propagates at an angle with respect to the normal direction. In typical arrayed speaker applications, individual smaller sized speakers are driven substantially in phase.

Another requirement for a quality combined wave from the array of smaller speakers includes setting the spacing between speakers to certain dimensions relative to sound wave wavelengths. As a rule of thumb, it is generally accepted that the spacing between two neighboring speakers must be smaller than the wavelength of an output sound wave to generate a combined wave. In some instances, it may be desirable for the spacing to be within half the wavelength of a particular sound wave. One reason for the requirement may be due to instances when the spacing is larger than a wavelength (or half the wavelength), wherein the resulting combination of the waves suffers from poor directional properties including unwanted side lobes of sound patterns away from the desired direction.

The wavelength of a wave may be determined as wave velocity divided by wave frequency. The wave velocity of sound in room temperature air is approximately 1130 ft/sec. For an exemplary low frequency audio sound having a frequency of 200 Hz, the corresponding wavelength is approximately 68". Similarly, a midrange audio sound with a frequency of 2000 Hz, the corresponding wavelength is approximately 6.8". For low frequency audio sound, a spacing between the speakers that is less than the wavelengths under the exemplary 68" is easily achieved. For midrange audio sound, arranging the midrange speakers with spacing under the exemplary 6.8", while more challenging than that of the low frequency case, is still achievable.

For a high frequency audio sound, a relatively small wavelength poses a problem for spacing of high frequency speakers, since the components of the speaker have physical limitations on how small they can be made. For example, a magnet assembly that drives a speaker cone needs to be a certain minimum size. As a result, positioning two of such speakers adjacent to each other yields a center-to-center spacing that suffers from directionality problems. Thus, a resulting high frequency sound emitted from a conventional array of high frequency speakers can suffer from the aforementioned directionality problems.

For the foregoing reasons, there is a continuing need for an improved system and method for transmitting a sound wave from a speaker or a plurality of speakers. In particular, there is a need for transmitting sound waves in a manner that allows for increasing of the dimension of the transmitted wavefronts while mitigating the undesired effects that degrade the sound quality, and allows for dimensions of the speaker assembly to be reduced.

SUMMARY OF THE EMBODIMENTS

One aspect of the disclosure relates an acoustic waveguide. In one embodiment a waveguide includes an input aperture configured to receive a sound signal from a sound source, and a plurality of isolated sound paths having substantially equal path lengths. Each isolated sound path is formed within a housing of the waveguide and configured to receive the sound signal from the input aperture such that the sound signal is divided into a plurality of sound signals. According to one embodiment, each isolated sound path is formed with a curved path to reduce the depth of the waveguide. The waveguide further includes a plurality of plugs, wherein each plug divides an output of one of the isolated sound paths into a plurality of output sound paths and defines a plurality of output apertures of the waveguide. Each output sound path is characterized by a reduced width relative to the output of the isolated sound path. The plurality of output apertures are configured to output a combined sound signal based, at least in part, on the plurality of sound signals.

According to another embodiment, a speaker assembly is provided. The speaker assembly including a driver that produces a sound signal, and a housing or speaker cabinet. The speaker cabinet housing can define a waveguide.

Other aspects, features, and techniques of the disclosure will be apparent to one skilled in the relevant art in view of the following detailed description.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figures 1A, 1B:
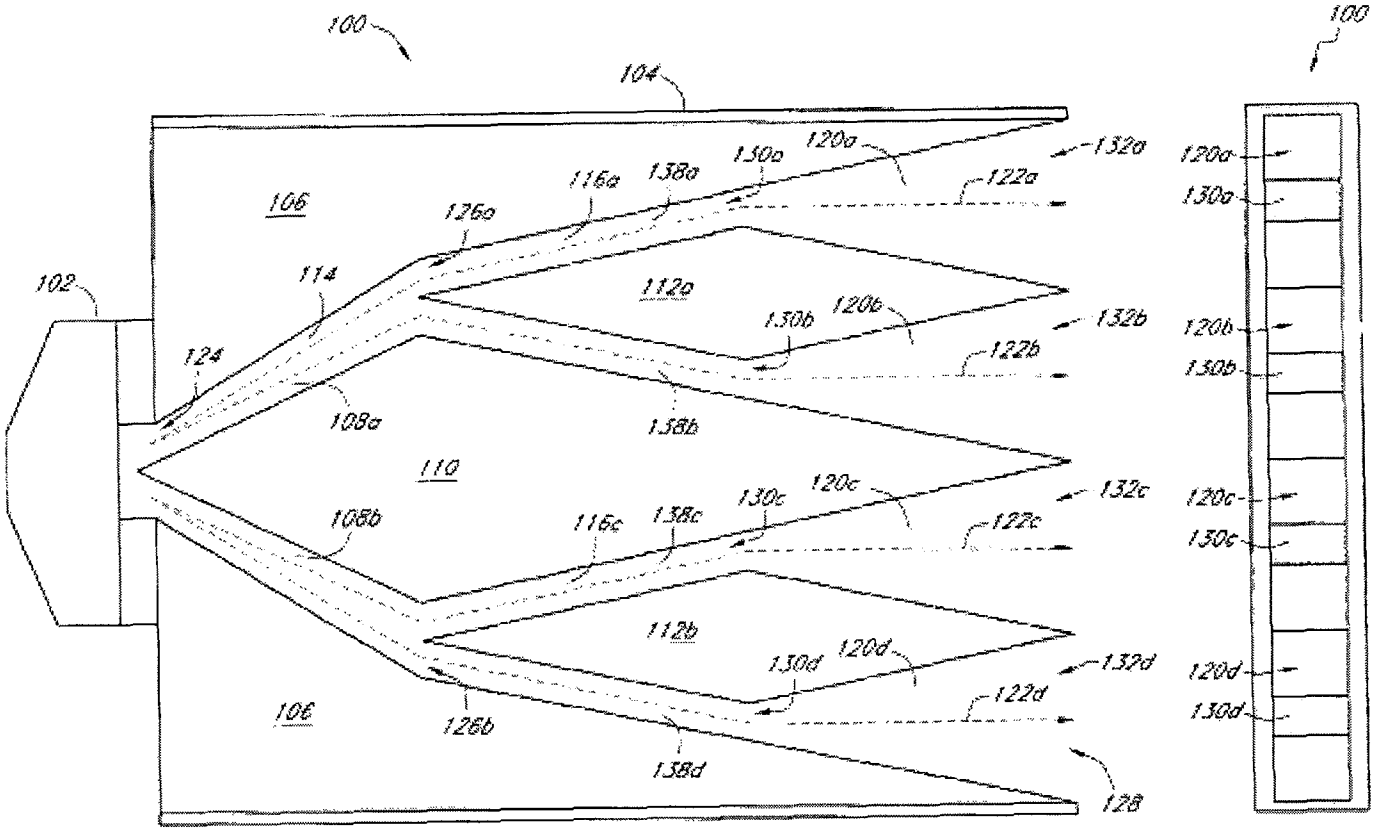
FIG. 1A depicts a side view of one embodiment of a horn assembly that provides multiple acoustic paths to multiple exit apertures to allow expansion of a relatively small sound source to a larger dimensioned exit.
FIG. 1B depicts a front view of the horn assembly of FIG. 1A.

One embodiment of the disclosure is directed to a waveguide. The waveguide may relate to a multiple-aperture acoustic horn that provides multiple paths for a sound wave emitted from a single driver (e.g., speaker driver). The waveguide may allow for a combined and substantially coherent sound signal to be output. In one embodiment, the waveguide may include a plurality of isolated paths for dividing an input signal to a plurality of sound signals. Path lengths of the isolated paths may be substantially equal in length. The multiple sound paths can be advantageously configured to suit various application needs. According to one embodiment, the isolated paths may be curved to reduce the depth of the waveguide. The curvature and/or design of the isolated sound paths may accommodate one or more of dimensions of the waveguide, characteristics of output apertures, and output characteristics of the waveguide. For example, curvature of the isolated sound paths may be based on one or more of the number of output apertures, spacing relative to each output aperture, and desired exit angles for each output aperture.

Another embodiment is directed to a speaker assembly. The speaker assembly may include a driver and a housing, or cabinet, including a waveguide. The waveguide may be formed by a waveguide structure. The configuration of the waveguide may allow for reduced size (e.g., depth, etc.) of the speaker assembly. The reduced size of the waveguide may allow for manufacturing of speaker assemblies that are lighter in weight, require less material, and/or allow for easier handling. In addition, the waveguide assembly may maintain the functional aspects of a multiple aperture acoustic device. The speaker assembly may advantageously be employed within an array of speaker assemblies.

Another aspect of the disclosure relates to a speaker assembly comprising a sound source that produces a sound signal. The speaker assembly further comprises a housing having an input aperture and a plurality of output apertures that are aligned in a first direction. The housing is attached to the sound source so as to receive the sound signal at the input aperture. The housing defines a plurality of isolated paths having substantially equal path lengths that link the input aperture to the plurality of output apertures. The sound signal is divided into a plurality of sound signals that are distributed in the first direction by travel along the plurality of isolated paths. The plurality of sound signals emanate from the plurality of output apertures at substantially the same time so as to combine to form a substantially coherent combined sound signal that is expanded in the first direction.

In one embodiment, the housing defines the plurality of isolated paths by one or more plugs having a first end biased towards the input aperture and a second end biased towards the output aperture. The first end of a given plug divides an existing path into two isolated paths and the second end of the given plug divides an existing output aperture into two smaller output apertures. The plug has a maximum width at a location between the first and second ends such that the isolated paths formed by the plug flare open into the output apertures.

The amount of flare and the corresponding dimension of the output aperture are selected such that the curvature $\delta$ of the wavefronts emanating therefrom is less than a quarter of the wavelength of the sound signal. The curvature $\delta=(L/2)\tan(\phi/2)$ where L is the dimension of the output aperture and $\phi$ is the opening angle of the flare. In one embodiment, the plug has a diamond shape elongated along a line that joins the first and second ends.

The aforementioned needs are satisfied by another aspect of the disclosure relating to a speaker assembly comprising a sound source that produces a first sound signal. The speaker assembly further comprises a horn assembly that receives the first sound signal and directs the first sound signal along a plurality of paths so as to expand the first sound signal into a plurality of sound signals that are distributed in at least a first direction. The horn assembly includes a plurality of flared apertures that are aligned in the first direction such that the plurality of sound signals emanate from the plurality of flared openings so as to produce a combined substantially coherent sound signal.

In one embodiment, the plurality of paths may include a plurality of isolated paths. In another embodiment, the horn assembly includes a housing having an output wall of a first length. The plurality of flared apertures may be formed in the output wall such that each of the plurality of sound signals have a length that is less than the first length so that the overall curvature of the combined substantially coherent sound signal is reduced to thereby facilitate coherent combination with sound signals emanating from adjacent sound sources.

In one embodiment, the horn assembly housing includes an input opening that receives the first sound signal from the sound source. The housing defines the plurality of paths, and the plurality of paths emanate outward from the input opening in a pattern where the outermost paths define first angle therebetween. The plurality of flared apertures are flared at an angle which is less than or equal to the first angle. The flare angle and the corresponding length of the sound signal are selected such that the curvature δ of the sound signal emanating therefrom is less than a quarter of the wavelength of the sound signal. The curvature $\delta=(L/2)\tan(\phi/2)$ where L corresponds to the length of the sound signal and ϕ is the flare angle.

The plurality of paths and their corresponding flared apertures are defined by one or more plugs having a first end biased towards the sound source and a second end biased towards the flared apertures. The first end of a given plug divides an existing path into two paths and the second end of the given plug divides an existing flared aperture into two smaller flared apertures. The plug has a maximum width at a location between the first and second ends. In one embodiment, the plug has a diamond shape elongated along a line that joins the first and second ends.

Another aspect of the disclosure relates to a speaker assembly comprising a sound source, and housing having a first input aperture and a first output aperture. The housing is attached to the sound source such that the first input aperture is adjacent to the sound source. The first output aperture is larger than the first input aperture along at least a first direction. The speaker assembly further comprises at least one plug positioned between the first input aperture and the first output aperture so as to define two or more smaller output apertures that are smaller than the first output aperture along at least the first direction. The first input aperture and the two or more smaller output apertures are linked by isolated paths having substantially equal path lengths. As such, the sound signal is divided into two or more sound signals that are distributed in the first direction by travel along the two or more isolated paths. The two or more sound signals emanate from the two or more smaller output apertures at substantially the same time so as to combine to form a substantially coherent combined sound signal that is expanded in the first direction.

In one embodiment, the two or more isolated paths may be flared along the corresponding two or more smaller output apertures. The plug has a first end biased towards the first input aperture and a second end biased towards the first output aperture. The first end of a given plug divides an existing path into two isolated paths and the second end of the given plug divides an existing output aperture into two smaller output apertures. The plug has a maximum width at a location between the first and second ends so as to provide the flaring of the isolated paths adjacent to corresponding smaller output apertures.

The amount of flare and the corresponding dimension of the smaller output aperture along the first direction are selected such that the curvature δ of the sound signals emanating therefrom is less than a quarter of the wavelength of the sound signal. The curvature $\delta=(L/2)\tan(\phi/2)$ where L is the dimension of the smaller output aperture and ϕ is the opening angle of the flare. In one embodiment, the plug has a diamond shape elongated along a line that joins the first and second ends.

In yet another aspect of the disclosure, an array of speakers includes a plurality of low frequency speakers arranged along a first direction. The low frequency speakers have a first dimension along the first direction. The array further comprises a plurality of high frequency speakers arranged along the first direction. Each high frequency speaker comprises a driver coupled to a horn assembly having an input aperture that receives a sound signal from the driver, and a plurality of flared apertures that are aligned in the first direction. The input aperture is linked to the plurality of flared apertures by a plurality of paths that direct the sound signal therethrough so as to expand the sound signal into a plurality of sound signals that are distributed in the first direction. The plurality of sound signals emanating from the plurality of flared openings can produce a substantially coherent combined sound signal.

In one embodiment, each of the plurality of flared apertures are dimensioned such that the curvature δ of the sound signals emanating therefrom is less than a quarter of the wavelength of the sound signal. The curvature $\delta=(L/2)\tan(\phi/2)$ where L is the dimension of the flared aperture and ϕ is the opening angle of the flare along the first direction. In one embodiment, the sum of the first direction dimension of the plurality of the flared apertures is at least 80% of the first dimension. The high frequency speakers may be arranged along a vertical direction. In another embodiment, each high frequency speaker further comprises a horizontal flare attached to the plurality of flared openings, thereby controlling the horizontal dispersion of the emanating sound signals.

In yet another aspect of the disclosure, a speaker assembly includes a sound source and a housing that defines an input aperture and two or more flared horn cavities having exit apertures. Each flared horn cavity has an opening angle and each exit aperture has a length along a first direction. The input aperture may be adjacent to the sound source, and the exit apertures are aligned along a first direction. The input aperture may be linked to the flared horn cavities by paths that are at least partially isolated from each other. The sound signal from the sound source may be distributed to the flared horn cavities and exit through the exit apertures. The opening angles of the flared horn cavities and the lengths of the exit apertures are selected so as to approximate a segmented line source of sound.

In one embodiment, each of the two or more flared horn cavities is dimensioned such that the curvature δ of sound wavefronts emanating therefrom is less than a quarter of the wavelength of the sound signal. The curvature $\delta=(L/2)\tan(\phi/2)$ where L is the length of the exit aperture and ϕ is the opening angle of the flared horn cavity.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Reference will now be made to the drawings wherein like numerals refer to like parts throughout. FIGS. 1A-1B depict an embodiment of a multiple-aperture acoustic apparatus 100 comprising a single speaker driver 102 attached to a horn assembly 104. As used herein, a multiple-aperture acoustic horn is an apparatus that provides multiple paths for a sound wave being emitted from a single speaker driver. The multiple paths can be advantageously configured to suit various application needs. The horn assembly 104 comprises a first horn 106 that has a back end and a front end, and the back end defines a first input aperture 124 dimensioned to receive the sound waves being emitted by the speaker driver 102. The first input aperture 124 may be a circular aperture to mate with a circular speaker driver. Alternatively, the first input aperture 124 may have any number of shapes and dimensions to mate efficiently with any number of speaker driver shapes.

The first horn 106 also defines a first exit aperture 128 at the front end that is larger than the first input aperture 124, thereby defining a horn shaped first cavity 114. As shown in FIG. 1A, a side sectional profile of the first cavity 114 generally opens up from the first input aperture 124 to the first exit aperture 128. As shown in FIG. 1B, a frontal view of the horn assembly 104 shows that in one embodiment, each cavity having a generally rectangular shape. It will be understood, however, that various other frontal shapes of the first cavity may be utilized without departing from the spirit of the disclosure. Various possible dimensions and materials that can be implemented for the first horn 106 are described below.

The horn shape of the first cavity 114, in absence of other structures described below, causes sound waves being emitted from the speaker driver 102 to generally cause the wavefronts of the sound waves to become rounded, thereby causing the directionality of the sound waves to spread out. If the speaker driver 102 pumps generally plane waves into the first input aperture 124, the wavefronts may become rounded due to the fact that wavefronts tend to be orthogonal to the boundaries. Thus, the degree of rounding of the wavefronts generally depends on the taper angle of the horn.

As is described below, two or more horn assemblies may be stacked vertically. The manner in which the sound waves from such horn assemblies combine depends on factors such as the frequency of the sound waves, dimension of the exit aperture, and the pitch of the taper. In audio applications, a generally accepted rule is that a curvature (defined below) of the rounded wavefront needs to be less than approximately ¼ of the wavelength $\lambda$ of the sound wave. One possible method determining the wavefront curvature is disclosed in an Acoustic Engineering Society convention paper titled "Line Arrays: Theory and Applications," authored by Mark S. Ureda and presented in May, 2001. The derivation of the wavefront curvature in the Ureda paper is in context of segmented line sources, but the general principle also holds in context of a horn shaped source.

Figure 2:
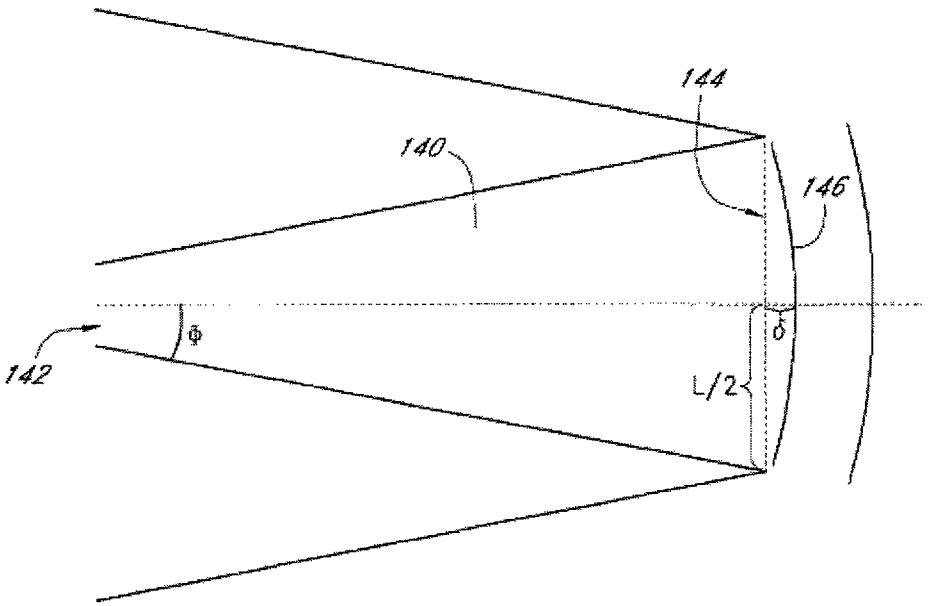
FIG. 2 depicts a horn cavity geometry and its effects on the emitted sound wave.

FIG. 2 depicts a generic horn shaped cavity and some corresponding geometry related parameters to put the wavefront curvature parameter in a proper context. A horn cavity 140 defined by flanking structures has an input aperture 142 and an exit aperture 144. The exit aperture 144 has a dimension of L along a direction perpendicular to a center axis). The horn cavity 140 tapers in an opening manner from the input aperture 142 to the exit aperture 144 at an opening angle of $\phi$ (angle between the center axis and one tapered side). As previously described, a wavefront propagating through such a tapered cavity becomes rounded. Thus, as a wavefront 146 exits the exit aperture 144, a distance from the face of the exit aperture 144 and the wavefront 146 along the center axis is defined as a wavefront curvature $\delta$. As derived in the Ureda paper, the curvature $\delta$ may be expressed as:

$$\delta=(L/2)\tan(\phi/2) \quad (1)$$

As seen in Equation 1, the curvature $\delta$ is proportional to the dimension L of exit aperture, and also increases with the opening angle $\phi$ within the range of 0 to 45 degrees. Thus, the parameters L and/or $\phi$ determine the limit on the effectively combinable wavelength (i.e., $\delta<\frac{1}{4}\lambda$) of the signals emitted from the horn cavity 140.

Based on the rule $\delta_{min}<\frac{1}{4}\lambda$, a minimum wavelength of effectively combinable sound wave can be expressed as:

$$\lambda_{min}=4\delta \quad (2)$$

Alternatively, since frequency of sound is a more common parameter used in audio industry, and since frequency and wavelength is related in a simple inverse relationship, Equation 2 can be expressed as:

$$f_{max}=c/4\delta \quad (3)$$

where c is the speed of sound and the curvature $\delta$ is determined from Equation 1. Thus, the geometry dependent parameters L and/or $\phi$ determine the maximum effectively combinable sound wave being emitted from a horn cavity. It will be understood that the frequency limit $f_{max}$ relates to the effective combining of the sound waves emanating from two or more horn cavities arranged in a linear array to approximate a segmented line source, and not necessarily to the sound quality of the individual horn cavity by itself.

In certain audio applications, it may be desirable to have the dimension L of the exit aperture conform to some selected value. For example, an ensemble of various speakers may form a plurality of vertical arrays, where each vertical array comprises either low frequency, mid-range, or high-frequency speakers (or horns extending therefrom). In one such configuration, a vertical stack of high-frequency speaker assemblies (e.g., speaker assembly comprising speaker driver and horn assembly) may be interposed between two vertical stacks of bass speakers. For various reasons, it may be desirable to have the vertical dimension of the exit aperture of the high-frequency speaker assembly be similar to that of the bass speaker. One difficulty encountered in such a design is that bass speakers are generally relatively large, thus the corresponding value of L partially determines the upper frequency limit of the high-frequency speaker assembly. For example, if L is approximately 9" (being positioned next to a 9" diameter bass speaker) and the opening angle $\phi$ is approximately 10 degrees, then the curvature $\delta$ is approximately 0.4", and the upper frequency limit $f_{max}$ is approximately 8.6 KHz which is substantially below what is considered a high-frequency audio range. Thus while such a horn may function well by itself as a high frequency component, an array of such horns yields a degraded quality combined sound wave when the frequency exceeds the exemplary $f_{max}$ of 8.6 KHz.

According to one aspect of the disclosure, various embodiments of horn assemblies comprise one or more wave dividing structures referred to herein as a plug. A plug, positioned in the horn cavity, may be shaped so as to define additional smaller exit apertures, and also provide different paths for the sound waves from the input aperture to the smaller exit apertures. Thus, a given plug may define a new set of exit apertures, each having a smaller dimension than the original dimension L. As described below in greater detail, each of the exit apertures advantageously has dimensions and opening angle that yield a higher value for the frequency limit $f_{max}$.

Referring to FIG. 1A, the horn assembly 104 comprises a first plug 110 positioned within the first horn cavity 114, thereby defining, along with the first horn 106, second horn cavities 116*a* and 116*b* having second input apertures 126*a* and 126*b* and second exit apertures 118*a* and 118*b*. Furthermore, the first plug 110 and the first horn 106 define first conduits 108*a* and 108*b* that respectively connect the first input aperture 124 to the second input apertures 126*a* and

126*b*. Thus, the sound wave originating from the first input aperture is split into two waves by the first plug 110, and the two waves travel through their respective first conduits 108*a* and 108*b*, through the second input apertures 126*a* and 126*b*, and into the second horn cavities 116*a* and 116*b*.

Preferably, the first plug 110 is dimensioned and positioned so as to be symmetric with respect to the axis of the first horn 106. Then, each of the second exit apertures 118*a* and 118*b* has a vertical dimension that is approximately half of the vertical dimension of the first aperture 128. Thus, for the aforementioned example where overall L=9" and ϕ=10 degrees, each of the newly formed two smaller horn cavities have l=L/2 and ϕ=10 degrees, thereby yielding $f_{max}$ of approximately 17 KHz (Equations 1-3). Such configuration of the horn assembly may be utilized for mid-range sound application if desired, or the exit apertures may be divided further, as described below, to achieve higher $f_{max}$.

As depicted in FIG. 1A, the horn assembly 104 further comprises second plugs 112*a* and 112*b* positioned respectively within the second horn cavities 116*a* and 116*b*, thereby defining, along with the first horn 106 and the first plug 110, third horn cavities 120*a*-120*d* having third input apertures 130*a*-*d* and third exit apertures 132*a*-132*d*. Furthermore, the second plugs 112*a* and 112*b*, the first plug 110 and the first horn 106 define second conduits 138*a*-138*d* that respectively connect the second input apertures 126*a* and 126*b* to the third input apertures 130*a*-130*d*. Thus, the two sound waves passing through the second input apertures 126*a* and 126*b* are split into four waves by the second plugs 112*a* and 112*b*. The four waves travel through their respective second conduits 138*a*-138*d*, through the third input apertures 130*a*-130*d*, and into the third horn cavities 120*a*-120*d*.

Preferably, the second plugs 112*a* and 112*b* are dimensioned and positioned so as to be symmetric with respect to the axes of their respective second horn cavities 116*a* and 116 *b*. Then, each of the third exit apertures 132*a*-132*d* has a vertical dimension that is approximately quarter of the vertical dimension of the first aperture 128. Thus, for the aforementioned example where the overall L=9" and ϕ=10 degrees, each of the newly formed four smaller horn cavities have l=L/4 and ϕ=10 degrees, thereby yielding $f_{max}$ of approximately 34 KHz (Equations 1-3) which is well above the audio high-frequency range. Such configuration of the horn assembly may be utilized for high-frequency sound application.

It will be appreciated that additional plugs may be incorporated in a manner similar to that described above to yield, for example, eight smaller exit apertures. While such a configuration is not necessary for the exemplary horn assembly with L=9" and ϕ=10 degrees, other larger sized horn assemblies may benefit from having eight or more smaller exit apertures. Furthermore, as the dimension L is divided with introduction of plug(s), the opening angles of the resulting horns may have opening angles different than that of their parent horn to achieve the desired result. For example, in the exemplary original configuration of L=9" and ϕ=10 degrees, the plug(s) may be configured such that the resulting smaller horns have different opening angles (than 10 degrees—for example, greater than 10 degrees) while achieving the desired value for $f_{max}$.

As previously described, the plugs are shaped and positioned so as to be symmetric with respect to their respective horn cavities. As depicted in FIG. 1A, such symmetry results in different sound paths 122*a*-122*d* having a substantially similar path length. Thus, the sound waves travelling via the sound paths 122*a*-122*d* and exiting the exit apertures 132*a*-132*d* are in phase with each other, and with other similar waves from other similar and stacked horn assemblies, thereby allowing substantially coherent combination of the waves.

The plugs described above in reference to FIG. 1A may have a side cross sectional shape of a diamond to fit within the straight walled horn cavities. The diamond shape has a first pointed end proximate its corresponding input aperture, thereby allowing efficient splitting of the sound wave into two symmetric pathways. The diamond shape may also include a second pointed end opposite from the first pointed end, thereby allowing a minimum vertical gap between adjacent exit apertures.

In other embodiments, the horn cavity is not straight walled. A flared horn cavity is one such example. As described below in greater detail, a plug for such a cavity may have some curvatures on its "facets" to accommodate the flare. Thus, it will be appreciated that the plug performing the aforementioned function may have different shapes and sizes without departing from the spirit of the disclosure.

Figure 3:
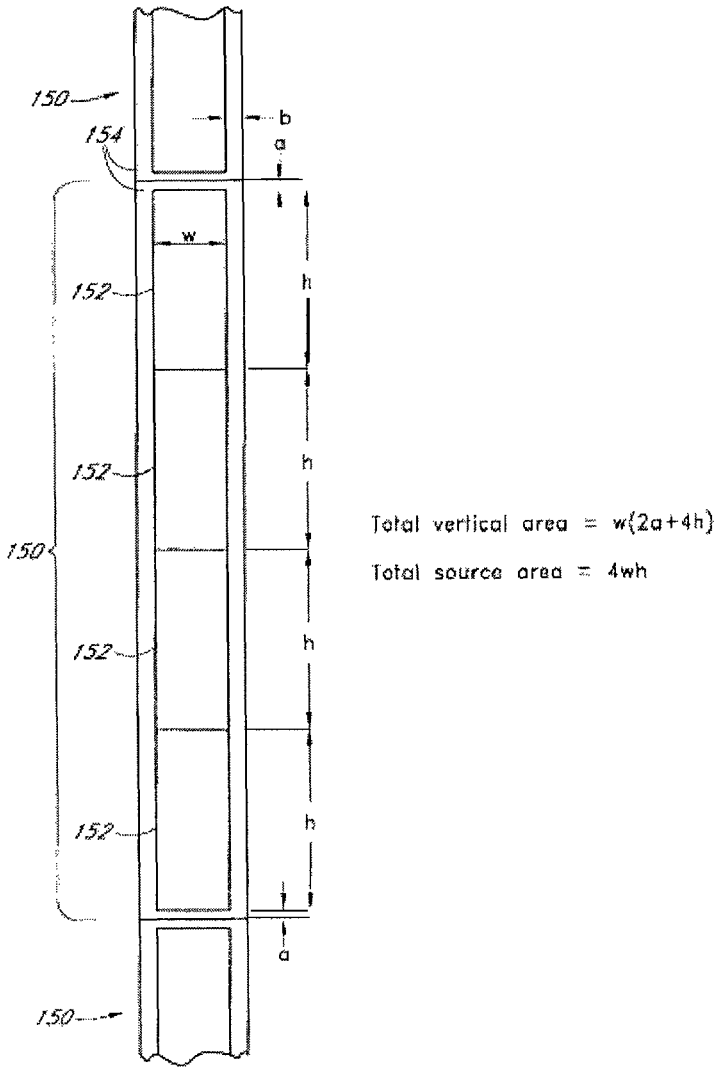
FIG. 3 depicts an array of horn cavities stacked vertically.

FIG. 3 depicts a stack of horn assemblies and the associated geometry parameters that can affect how well sound waves combine. As discussed above, the spacing between adjacent sound sources relative to the wavelength can affect how effectively sound waves combine. In FIG. 3, a plurality of exit apertures 152 can be considered to be sound sources. The source-to-source (e.g., center-to-center) distance is h, which, for an exemplary 9" horn assembly with four exit apertures, is approximately 2.25". This distance is greater than the 0.68" source spacing (for the 20 KHz sound) discussed above. It should be understood that the exemplary 0.68" spacing is for a circular wavefront (e.g., isotropic) being emitted from the source (e.g., a point source). As described above, the sound wave emerging from the horn exit aperture may be controlled to behave like a finite length line source, thereby allowing the substantial increase in the workable vertical dimension of the source Despite the fact that the vertical dimension of the source, and hence the center-to-center spacing of the sources can be increased substantially by the apparatus described herein, it may nevertheless be advantageous to minimize gaps between the adjacent exit apertures. One reason is that the combining effects of the curved wavefronts degrade at greater distances.

The exit apertures described above in reference to FIG. 1 and FIG. 3 may be defined by the pointed (side view; an edge in front view) second ends of the diamond shaped plugs. Thus, gaps between the exit apertures within the same horn assembly may be minimal. However, as shown in FIG. 3, a horn assembly 150 may comprise an outer housing 154 such that when stacked with another horn assembly 150, the housings 154 may form a gap between the two end exit apertures. In FIG. 3, this vertical gap is depicted as having a dimension identified as 2a. One possible method of quantifying the acceptable limit on the gap is disclosed in the Acoustic Engineering Society Preprint #5488 titled "Wavefront Sculpture Technology", authored by Urban, Heil, and Bauman in 2001, where a ratio of the total source area to the total "vertical" area of 80% or greater is considered to be acceptable. The vertical area is simply a portion of the total area of the front face that is covered if the source (horn apertures in this case) extends vertically. Thus, the vertical area would not include the area covered by the side walls with thickness of b.

As shown in FIG. 3, the total vertical area of the horn assembly 150 is w(2a+4h), while the total source area is 4wh. In one embodiment, the horn exit aperture has a height h of approximately 2.25", and a width w of approximately 1". Furthermore, the top and bottom housing thickness is approximately ⅛". Thus, the total source area may be approximately 9 square inches and the total vertical area may be approximately 9.25 square inches, yielding a ratio of approximately 97% that is well above the acceptable limit.

Figure 4A:
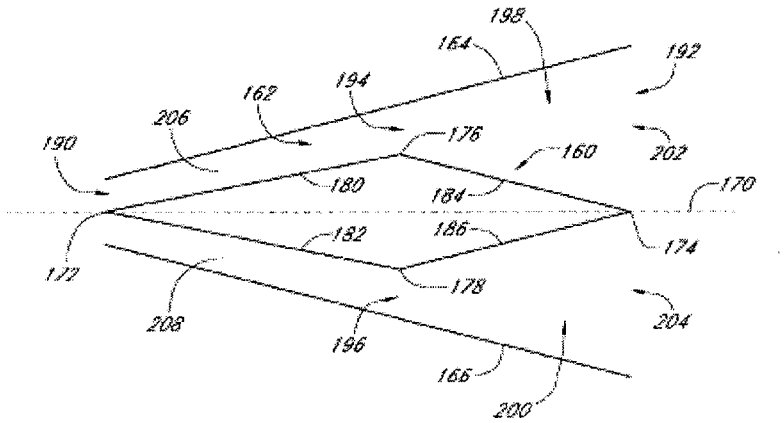
FIGS. 4A and 4B depict some possible embodiments of a plug that is positioned within a larger horn cavity to produce two smaller horn cavities, thereby allowing desirable horn geometry to be obtained for effective combining of the emitted sound waves.
Figure 4B:
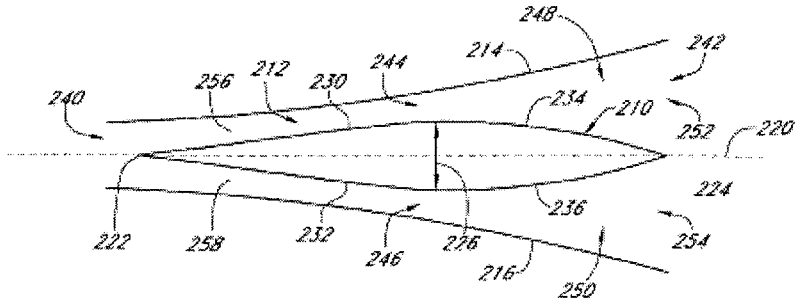

FIGS. 4A-4B depict some common properties of the plugs described above in reference to FIG. 1A, and those of other various embodiments described below. FIG. 4A depicts a straight walled horn cavity 162 defined by first and second boundaries 164 and 166 that opens up from an input aperture 190 to an exit aperture 192. Such boundaries may be part of a main horn (e.g., first horn 106 of FIG. 1A) or part of a larger plug. A plug 160 is positioned within the cavity 162 in a generally symmetric manner such that a longitudinal axis 170 of the plug 160 generally coincides with a longitudinal axis of the horn cavity 162.

In one embodiment, a side vertical cross section of the plug 160 has a diamond shape, with a first end 172 and a second end 174 positioned along the longitudinal axis 170. The diamond shaped plug 160 further comprises side vertices 176 and 178 that form the widest lateral dimension of the plug 160 between the first end 172 and second end 174. The first end 172 and the side vertices 176 and 178 are joined by interior edges 180 and 182, respectively. In a similar manner, the side vertices 176 and 178 and the second end 174 are joined by exterior edges 184 and 186, respectively. The interior edges 180 and 182 and the boundaries 164 and 166 define conduits 206 and 208, respectively, from a location proximate the input aperture 190 to a location proximate the side vertices 176 and 178. The exterior edges 184 and 186 and the boundaries 164 and 166 define, respectively, two new horn cavities 198 and 200 having input apertures 194 and 196 defined by the boundaries 164 and 166 and the side vertices 176 and 178, and exit apertures 202 and 204. Exit apertures 202 and 204 may be defined by the boundaries 164 and 166 and the second end 174 of the plug 160.

It will be appreciated that the diamond shape of plug 160 as described above in reference to FIG. 4A can be varied in a number of ways to obtain a number of desired configurations of the plug 160 with respect to the horn cavity 162. For example, the lateral dimension of the plug 160 at the side vertices 176 and 178 can be increased or decreased to increase or decrease the dimensions of the conduits 206 and 208 and the input apertures 194 and 196. Furthermore, the longitudinal location of the side vertices 176 and 178 can also be varied to alter the general shape of the horn cavities 198 and 200. In one particular embodiment, the horn cavities created by the plug 160 have a similar but scaled down horn profile as that of the original horn cavity. It will be appreciated, however, that the scaled down horn profiles do not have to have a similar profile as the original profile.

FIG. 4B depicts another embodiment of a horn cavity. Flared horn cavity 212 may be defined by first and second curved boundaries 214 and 216 that open up from an input aperture 240 to an exit aperture 242. Such boundaries may be part of a main horn or part of a larger plug. A plug 210 is positioned within the cavity 212 in a generally symmetric manner such that a longitudinal axis 220 of the plug 210 generally coincides with a longitudinal axis of the horn cavity 212.

In one embodiment, the side vertical cross section of plug 210 has an at least partially curved double ended spear shape, with a first end 222 and a second end 224 positioned along the longitudinal axis 220. The plug 210 further comprises a widest lateral dimension location, indicated by a double ended arrow 226, somewhere between the first and second ends 222 and 224. The first end 222 and both sides of the laterally widest location 226 are joined by interior edges 230 and 232, respectively. In a similar manner, both sides of the laterally widest location 226 and the second end 224 are joined by exterior edges 234 and 236, respectively. The interior edges 230 and 232 and the boundaries 214 and 216 define conduits 256 and 258, respectively, from a location proximate the input aperture 240 to a location proximate the laterally widest location 226. The exterior edges 234 and 236 and the boundaries 214 and 216 define, respectively, two new horn cavities 248 and 250 having input apertures 244, 246 defined by the boundaries 214 and 216 and the laterally widest location 226, and exit apertures 252 and 254 defined by the boundaries 214 and 216 and the second end 224 of the plug 210.

It will be appreciated that an at least curved shape of plug 210 as described above in reference to FIG. 4B can be varied in any number of ways to obtain any number of desired configuration of the plug 210 with respect to the horn cavity 212. For example, the lateral dimension of the plug 210 at the laterally widest location 226 can be increased or decreased to increase or decrease the dimensions of the conduits 256 and 258 and the input apertures 244 and 246. Furthermore, the longitudinal location of the laterally widest location 226 can also be varied to alter the general shape of the horn cavities 248 and 250. In one particular embodiment, the horn cavities created by the plug have a similar but scaled down horn profile as that of the original horn cavity. It will be appreciated, however, that the scaled down horn profiles do not have to have a similar profile as the original profile.

Figure 5A:
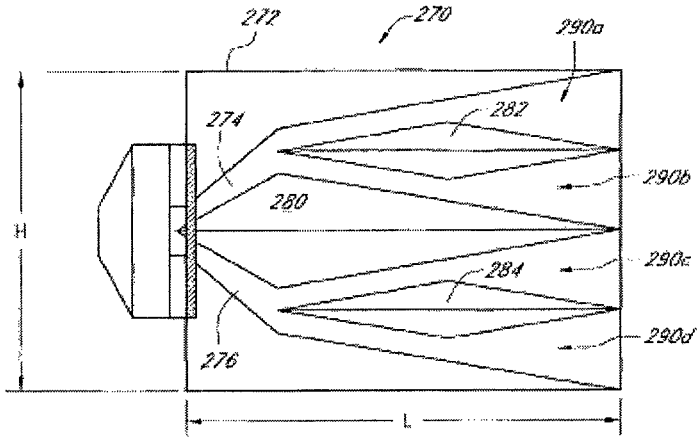
FIGS. 5A-5B depict some possible embodiments of the horn assembly where the plugs are diamond shaped to yield straight walled horn cavities.
Figure 5B:
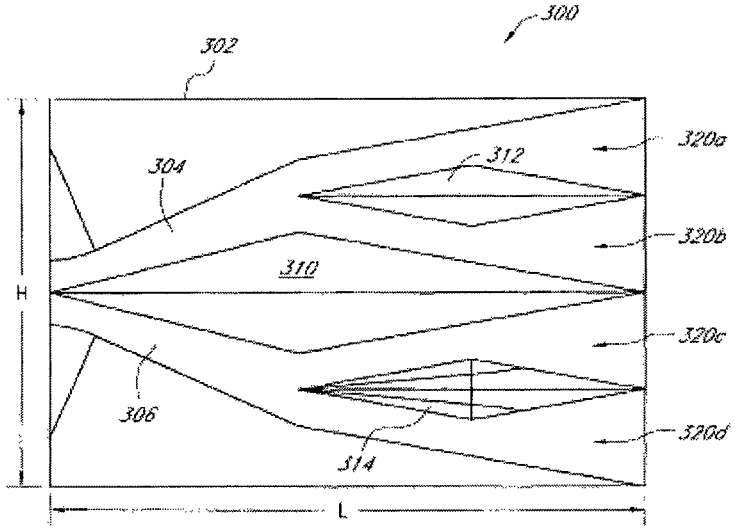
Figure 5C:
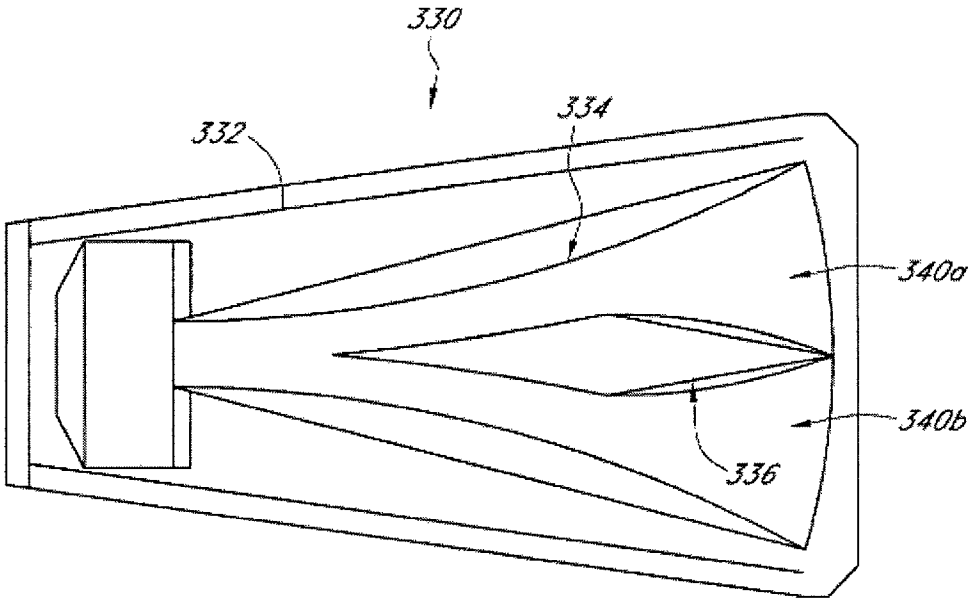
FIG. 5C depicts one possible embodiment of the horn assembly where the plug has a curved profile to accommodate flared wall horn cavities.

FIGS. 5A-5C depict possible embodiments of the horn assembly described above. In one embodiment, a horn assembly 270 comprises a plug 280 positioned within a cavity defined by a first horn 272. An interior portion of the plug 280 and the cavity define first conduits 274 and 276. An exterior portion of the plug 280 and the cavity defines two smaller secondary cavities in which secondary plugs 282 and 284 are positioned, thereby creating front end cavities 290*a*-290*d*.

As seen in FIG. 5A, the plug 280 and its corresponding cavity wall are dimensioned such that the conduits 274 and 276 are directed at an angle that is larger than the opening angle of the end cavities 290*a*-290*d*. This feature is achieved by the plug 280 having side vertices positioned towards the interior portion of the cavity. In one embodiment, the horn assembly 270 has exterior dimensions of approximately 12" (L)×9" (H).

FIG. 5B depicts another embodiment, including horn assembly 300 having a plug 310 positioned within a cavity defined by a first horn 302. The plug 310 has side vertices that are located more towards its center (e.g., relative to that of the plug 280 in FIG. 5A), such that resulting conduits 304 and 306 are oriented at a smaller angle than the angle of the conduits 274 and 276 described above. Secondary plugs 312 and 314 are positioned to create front end cavities 320*a*-320*d*. In one embodiment, the horn assembly 300 has exterior dimensions of approximately 12.5" (L)×8.2" (H).

FIG. 5C depicts yet embodiment, a flared horn assembly 330 having a first horn 332 that defines a flaring cavity 334. Positioned within the cavity 334 is a horn 336 that yields two end horn cavities 340*a* and 340*b* in a manner described above in reference to FIG. 4B.

The exemplary profiles of the cavities and their corresponding plugs, described above in reference to FIGS. 5A-5C, show that the configuration horn assembly can be varied in a number of ways to accommodate the desired dimension. Similarly, the configuration can be varied to allow sound quality tuning to suit various applications.

Figure 6A:
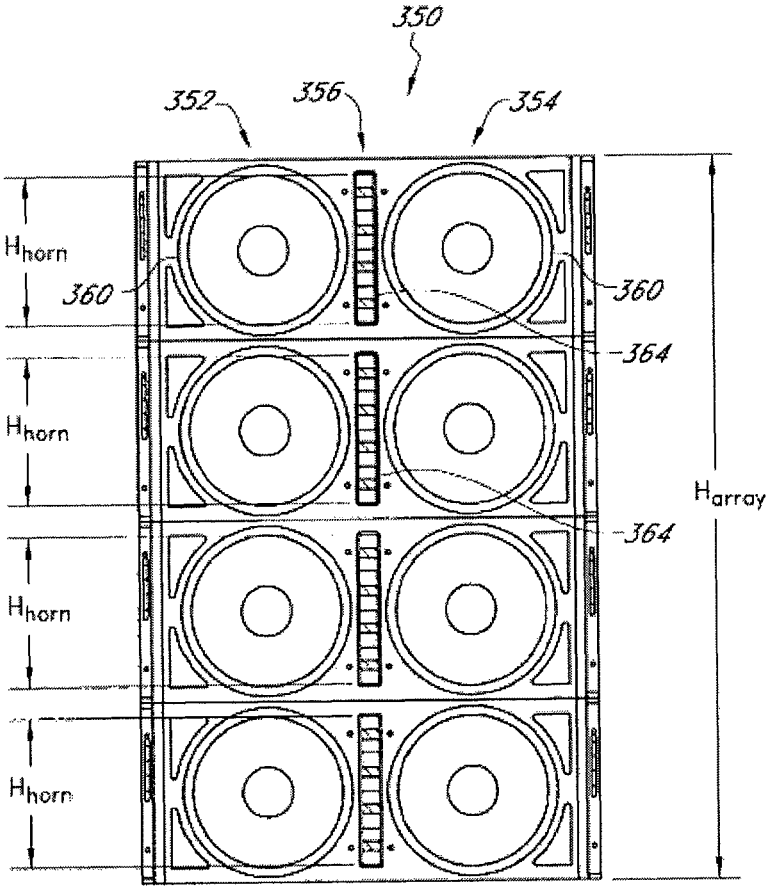
FIGS. 6A-6B depict some possible methods of arraying the enlarged exits provided by various embodiments of the horn assembly.
Figure 6B:
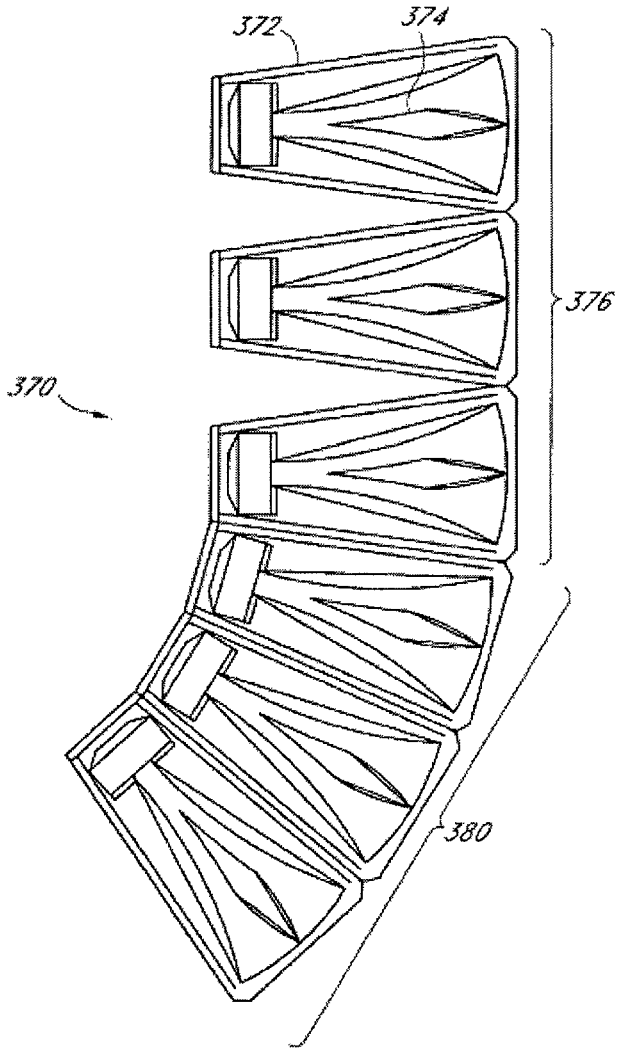

FIGS. 6A-6B depict graphical representations of possible horn assemblies. FIG. 6A depicts a speaker array 350 comprising a stack 356 of high frequency horn assemblies 364 interposed between two stacks 352 and 354 of bass speakers 360. The vertical dimension of the horn assembly 364 may be selected to be similar to the vertical dimension of the bass speakers 360.

In one embodiment of the stack 356 depicted in FIG. 6A, each of the four high frequency horn assemblies 364 has an actively transmitting area that has a vertical dimension $H_{horn}$, of approximately 9". The array 350 has an overall height $H_{array}$ of approximately 43.9". Thus, the fraction (vertical) of actively transmitting area in such a configuration is approximately 4×9/43.9=0.82, which satisfies the previously described 80% rule.

FIG. 6B depicts an ensemble 370 of flared horn assemblies 372 arranged in two possible configurations. Each of the horn assembly 372 defines a flared horn cavity, and a plug 374 is positioned therein in a similar manner to that described above in reference to FIG. 5C. The horn assembly 372 has an angled exterior such that an exit end dimension is greater than a speaker driver end dimension. As such, the horn assemblies 372 can be arranged in a first exemplary configuration 376 wherein the front faces of the exit apertures are aligned in a same plane. Alternatively, the horn assemblies 372 can be arranged in a second exemplary configuration 380 wherein the angled sides of the adjacent horn assemblies engage each other, such that the front faces of the exit apertures fan out. The first configuration 376 generally offers more directionality of the sound emitted therefrom, and the fanned second configuration 380 offers more coverage, if desired.

Figure 7A:
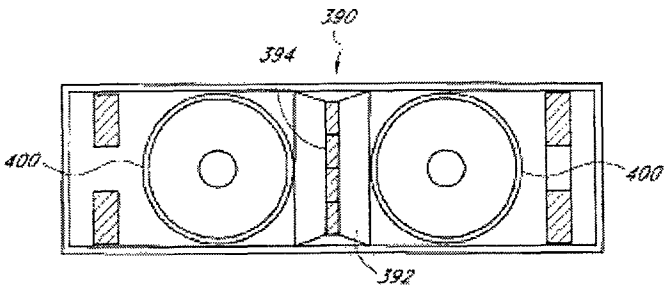
FIGS. 7A-7B depict one embodiment of the horn assembly having a horizontal flare at the horn exit thereby allowing control of the horizontal coverage of the emitted sound.
Figure 7B:
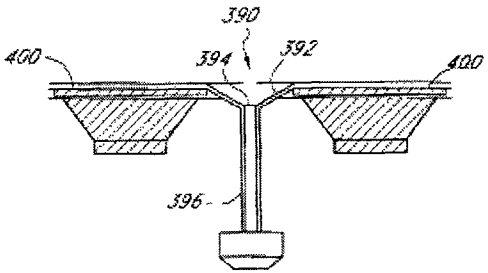

FIGS. 7A and 7B depict one possible embodiment of a horn assembly 390 having a horizontal flare 392 attached to vertically oriented exit apertures 394. A horn assembly without the horizontal flare 392 may be one of the horn assemblies described above. As previously described, the sound emanating from the exit apertures 394 (e.g., without the horizontal flare) generally has a cylindrical shaped wavefronts generally having a cross sectional shape of a half circle. Thus, such a cylindrical wave spreads in a range of approximately 180 degrees. While such spreading of the cylindrical wave covers a wide horizontal range, range is reduced because of the wide spreading. By placing the horizontal flare 392 in front of the exit apertures 394, the horizontal spreading of the wavefronts may be controlled in an advantageous manner. For example, the horizontal flare 392 has an opening angle less than 180 degrees, thereby reducing the horizontal dispersion and extending the range of the waves. Thus, it will be appreciated that the opening angle of the horizontal flare 392 may be selected from a range of approximately 0-180 degrees to control the horizontal coverage and the range as desired.

The horn assembly 390 having the horizontal flare 392 may be used in conjunction with large bass speakers 400, as shown in FIGS. 7A and 7B. Furthermore, such a combination high frequency horn assembly 390 and the bass speakers 400 may be stacked vertically in a manner similar to that described above in reference to FIG. 6A. Alternatively, the horn assembly 390 may be operated by itself or arrayed with other horn assemblies (with or without the horizontal flares), without being proximate the bass speakers, without departing from the spirit of the disclosure.

Various embodiments of the horn assembly described herein extend the dimension of the wavefront along the vertical direction. It will be understood that the vertical direction is only one possible preferred direction. The novel concept of increasing the output dimension of the horn assembly along a preferred direction by forming a plurality of apertures along the preferred direction is applicable with any choice of the preferred direction, including the horizontal direction.

The vertically oriented horn assemblies disclosed herein comprise various plug structures that isolate the plurality of apertures and acoustic paths from each other vertically. Vertically isolated multiple apertures and paths are described above with reference to FIGS. 1A-1B, 3, 5A-5C, 6A-6B, and 7A-7B. In one aspect of the disclosure, the multiple apertures and their corresponding paths being isolated along the preferred direction allows the plugs to be configured in a relatively simple manner. In particular, as exemplified in the side sectional view of one embodiment in FIG. 1A, the plugs may be relatively simple slabs having appropriate side profiles. For example, the plugs 112*a* and 112*b* in FIG. 1A may be diamond shaped slabs, with the slab thickness being approximately same as the horizontal width of the multiple apertures thereby vertically isolating them from each other. Such a configuration allows, if desired, the horizontal dimension of the horn portion to be relatively thin, thereby providing more flexibility in design and implementation of the horn assembly. In certain embodiments, such as that shown in FIG. 7B, the horn portion (other than the horizontal flare) of the assembly may be substantially narrower than the horizontal dimension of the driving element at the rear. In such applications, the depth of the horn assembly may be sufficiently large to allow the driving element from interfering with the adjacent bass speakers. Thus, if the horizontal flare is absent in the configuration of FIG. 7B, the two flanking bass speakers may be brought closer together if desired.

Various embodiments of the horn assembly described above utilize one or more plugs to allow advantageous increase in the exit dimension. The plugs and their corresponding horns can be constructed in a variety of ways using any of the acoustic materials. The material may include, by way of example, aluminum, polyvinyl chloride (PVC), glass filled nylon, urethane, or any number of acoustically favorable materials. By way of example, these materials may be formed by machining, sand casting, injection molding, or any number of processes configured to form three dimensional objects. It will be appreciated that the various embodiments of the novel concepts described herein may be formed by one or more, or any combination of the aforementioned fabrication methods from one or more, or any combination of the aforementioned materials without departing from the spirit of the disclosure.

Although the foregoing description has shown, described and pointed out the fundamental novel features of the disclosure, it will be understood that various omissions, substitutions, and changes in the form of the detail of the apparatus as depicted as well as the uses thereof, may be made by those skilled in the art, without departing from the spirit of the disclosure. Consequently, the scope of the present disclosure should not be limited to the foregoing discussions, but should be defined by the appended claims.

Figure 8:
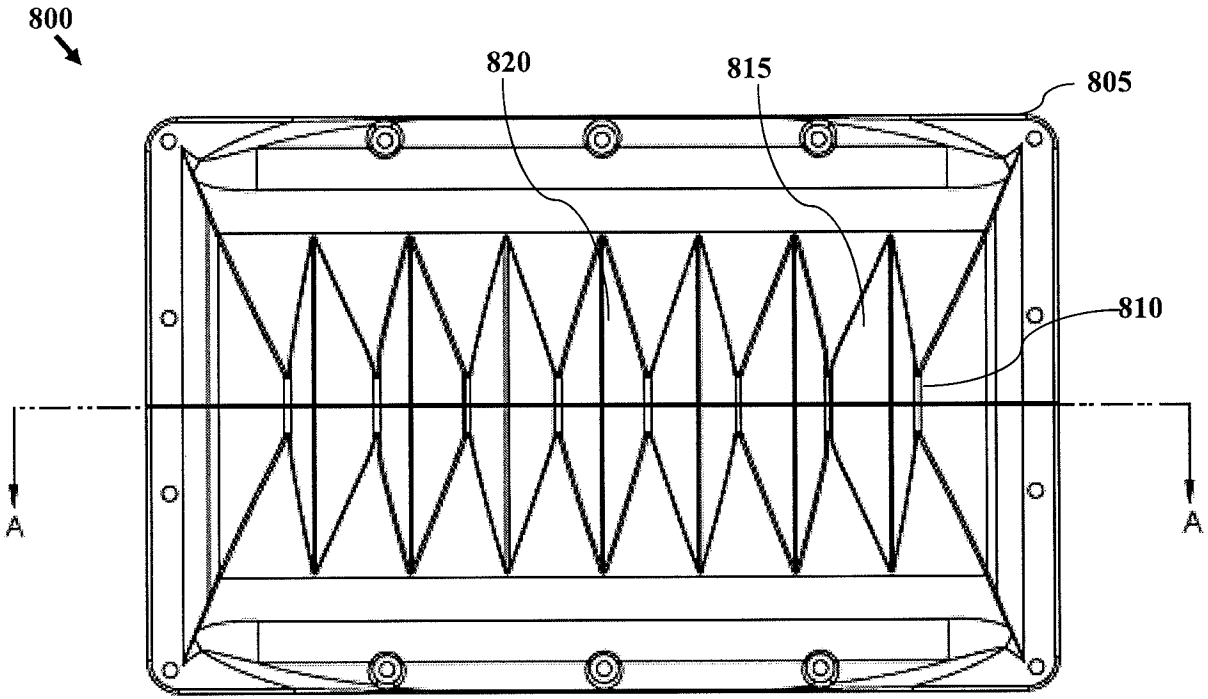
FIG. 8 depicts a frontal view of a speaker assembly according to one or more embodiments.

Referring now to FIG. 8, a frontal view is depicted of a speaker assembly according to one or more embodiments. Speaker assembly 800 includes housing 805 and a plurality of output apertures, shown as 810, of a waveguide. Housing 805 may relate to a sealed enclosure, or cabinet, configured to support a driver. Sound waves may be transmitted from the front of speaker assembly 800 based on one or more sound signals received from the driver. A waveguide within housing 805 may be configured to expand the size of sound emanating from the driver. Sound signals output by the driver may be distributed to output apertures 810 by a waveguide structure within housing 805 of speaker assembly 800. In certain embodiments, housing 805 may relate to multiple elements, wherein the elements may be sealed to form speaker assembly 800. Housing 805 may be manufactured from one or more elements and may be formed by injection molding, machining, casting, etc.

Housing 805 may include a waveguide, or waveguide structure, that receives the first sound signal and directs the first sound signal along a plurality of paths so as to expand the first sound signal into a plurality of sound signals that are distributed in at least a first direction. Housing 805 includes a plurality of expended openings 820 associated with output apertures 810 that are aligned in the first direction such that the plurality of sound signals emanate from the plurality of expanded openings so as to produce a combined substantially coherent sound signal. It should be appreciated, however, that various frontal shapes of expanded openings 820 may be utilized.

Output apertures 810 of speaker assembly 800 may be formed by plugs, shown as 815, and expended openings of housing 805, shown as 820. The plurality of output apertures in FIG. 1 may be aligned to transmit sound in a first direction, or relative to the front face of speaker assembly 800. In one embodiment, output apertures 810 may be associated with one of a linear and curvilinear front face. As such, output apertures 810 may be arranged in one of a linear and curvilinear array. The output distributed by the output apertures 810 of speaker assembly 800 may expand sound in one or more of horizontal and vertical directions.

Housing 805 may form one or more expanded openings depicted as 820. The exit angle and the corresponding dimension of output apertures 810 may be selected such that the curvature δ of the wavefronts emanating from the speaker assembly is less than a quarter of the wavelength of the sound signal. The curvature may be characterized as: $\delta=(L/2)\tan(\phi/2)$, where L is the dimension of the output aperture and q is the opening angle of the expanded opening.

Figure 9:
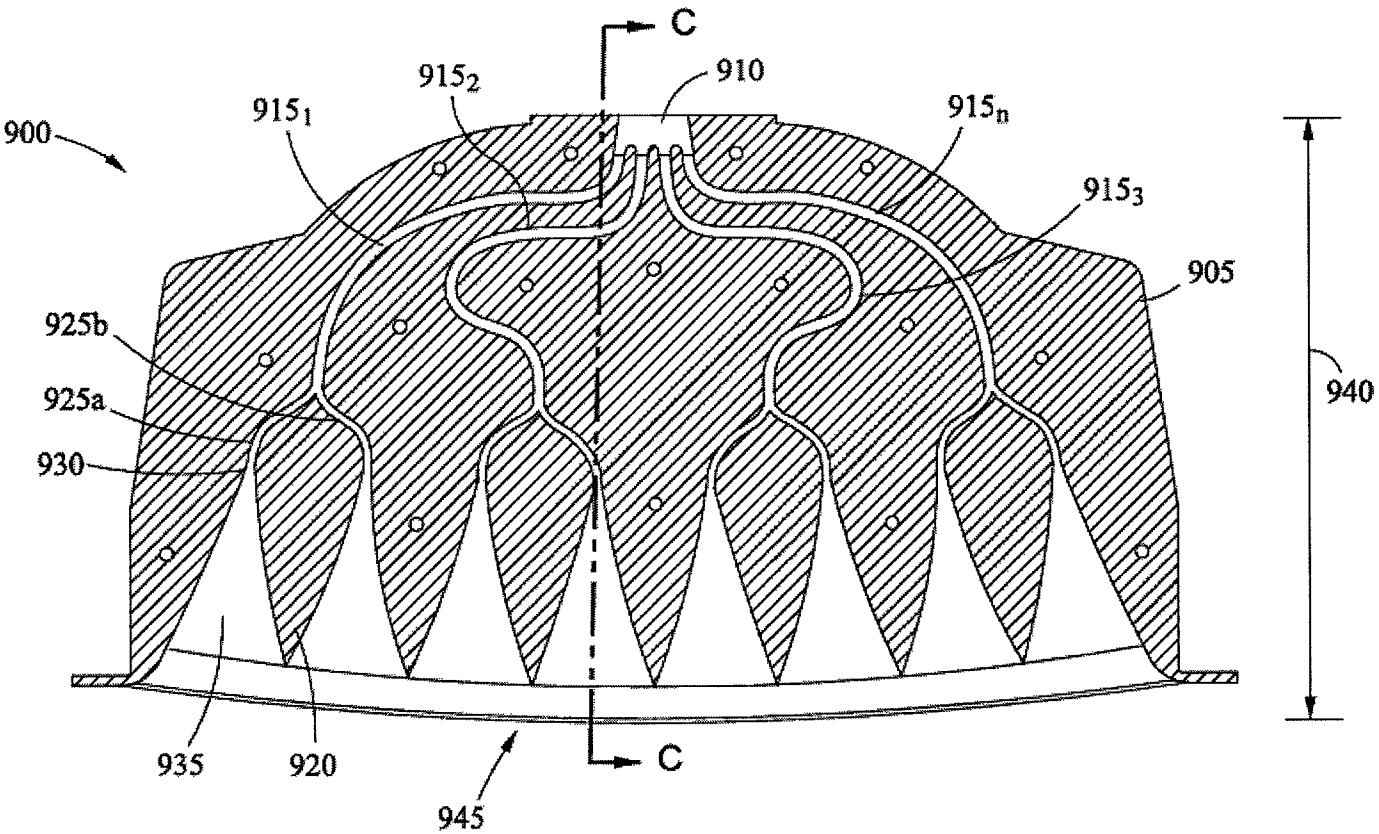
FIG. 9 depicts a graphical representation of a waveguide structure according to one or more embodiments.

FIG. 9 depicts a graphical representation of a waveguide structure according to one or more embodiments. Waveguide 900 may be employed by a speaker assembly, such as the speaker assembly of FIG. 8. As depicted, waveguide 900 relates to a cross-sectional view of the speaker assembly of FIG. 8 taken along the line A-A.

Waveguide 900 may be formed within housing 905 (e.g., housing 105). In certain embodiments, sound paths of waveguide 900 may be formed by housing 905. For example, the structure of housing 905 may include one or more channels serving as sound paths for waveguide 900. According to one embodiment, waveguide 900 includes a plurality of isolated sound paths, shown as $\mathbf{915}_{1\text{-}n}$. Isolated sound paths $\mathbf{915}_{1\text{-}n}$ may each be divided by a plug, such as plug 920, to form a pair of output paths, depicted as 925*a* and 925*b*. In that fashion, input aperture 910 is linked to an output aperture by way of an isolated sound path and an output path. By way of example, input aperture 910 is linked to output aperture 930 (e.g., output aperture 110) by way of isolated sound path $\mathbf{915}_1$ and output path 925*a*.

Housing 905 may be employed for a speaker assembly, or cabinet, to mount a driver (not shown in FIG. 2). The driver may be mounted relative to input aperture 910. Input aperture 910 may be configured to receive a sound signal from a sound source, such as a sound signal from a driver coupled to waveguide 900. The dimensions of input aperture 910 may be based on one or more of the size of a driver to be employed, the dimensions of a speaker cabinet, frequency characteristics, and number of sound paths of waveguide 900. Input aperture 910 may be a circular aperture to mate with a circular driver. Alternatively, input aperture 910 may have any number of shapes and dimensions to mate efficiently with any number of driver shapes.

According to one embodiment, the configuration of isolated sound paths $\mathbf{915}_{1\text{-}n}$ may be employed by the waveguide to allow for a combined output signal and allow for a housing with reduced depth. An isolated sound path may relate to a continuous path for guiding sound waves. In certain embodiments, the isolated sound path may not include any branches. Output of the isolated sound paths, however, may be divided. According to one embodiment, isolated sound paths $\mathbf{915}_{1\text{-}n}$ may have substantially equal path lengths. According to another embodiment, isolated sound paths $\mathbf{915}_{1\text{-}n}$ may divide a received sound signal into a plurality of sound signals. An isolated sound path may be characterized by a cylindrical shape one-quarter (¼) the size of input aperture 905. Equal path lengths of the isolated paths direct sound signals to a plurality of plugs, such as plug 920, in a substantially similar amount of time. Plug 920 may be characterized by a diamond shape elongated along a line that joins upper and lower portions of housing 905.

In one embodiment, each of the isolated sound paths $\mathbf{915}_{1\text{-}n}$ may be formed by housing 905 of the waveguide structure. In certain embodiments, isolated sound paths $\mathbf{915}_{1\text{-}n}$ may be formed by an upper and lower portion of a housing of the waveguide structure. For example, housing 905 may be a split housing, wherein channels formed by an upper portion of the housing and lower portion of the housing form sound guides or paths for isolated sound paths $\mathbf{915}_{1\text{-}n}$ and expanded openings 935.

The sound paths of waveguide 900 may be further defined by a plurality of plugs, such as plug 920. Each plug defines a plurality of output apertures, such as 930, of waveguide 900. As depicted, each plug is biased with a first end and second end, wherein the maximum width of the plug is arranged in closer proximity to output apertures 930. In that fashion output sound paths 925*a* and 925*b* may be formed by surfaces of housing 905.

Plugs of waveguide 900 may define one or more output paths of a waveguide structure for output of sound. The output sound paths may link isolated sound paths $\mathbf{915}_{1\text{-}n}$ of the waveguide to output apertures. Each of the plugs, such as plug 920 may have a first end biased towards an isolated input path and a second end biased towards the front face of waveguide 900. The first end of a given plug may divide an isolated sound path into two isolated paths, or output paths, and the second end of the given plug forms an expanded opening 935. Plug 920 may have a maximum width at a location between the first and second ends such that the isolated paths formed by the plug expanding into the expanded opening 935. Plug 920 may be shaped and positioned so as to be symmetrical with respect to a respective horn cavity, such symmetry can result in different sound paths having substantially similar path lengths. Thus, the sound waves traveling via the sound paths and exiting output aperture 930 will be in phase with each other, and with other similar waves from other similar and stacked speaker assemblies, thereby allowing for a substantially coherent combination of sound waves from one or more speaker assemblies. According to another embodiment, plug 920 may have some curvature on the facets of the plug to accommodate a desired exit angle. According to one embodiment, waveguide 900 may be configured to extend the dimensions of a wavefront along one or more of horizontal and vertical directions.

Each output sound path of waveguide 900, such as paths 925*a* and 925*b*, may be characterized by a reduced width relative to the isolated sound paths $\mathbf{915}_{1\text{-}n}$. In addition, each output path may relate to a cylindrical path one eight (⅛) the dimension of input aperture 910 (e.g., one-half (½) the dimension of an isolated sound path). The plurality of isolated sound paths $\mathbf{915}_{1\text{-}n}$ and output paths link input aperture 910 to the output apertures, such as output aperture 930, of waveguide 900.

In yet another embodiment, each of the isolated sound paths $915_{1-n}$ may be formed with a curved path to reduce the depth of the waveguide structure, shown as 940. For example, each isolated sound path may be curved within a plane. Using a curved sound path for isolated sound paths $915_{1-n}$ enables uniform sound propagation path lengths from a finite inlet aperture, such as input aperture 910, to a plurality of outlet apertures, such as output aperture 930, arrayed in a first direction along either a straight or curvilinear line. Based on at least one characteristic of waveguide 900 the depth of the waveguide may vary. By way of example, depth of the waveguide may be approximately 60% of the overall height of waveguide 900. The range of depth can be as little as 2.5 inches (89 mm) and as much as 13.5 inches (343 mm), with typical embodiments being on the order of 6.6 inches (168 mm) to 8.4 inches (213 mm). However, it should be appreciated that the embodiments described herein may relate to other depths and are not limited by these exemplary values.

Waveguide 900 may be configured to output a combined sound signal based, at least in part, on the plurality of sound signals output from the output apertures. Waveguide 900 may be characterized by one of a linear and curvilinear front face 945, wherein output sound waves are distributed by output apertures based on the geometry of front face 945. In one embodiment, the plurality of sound signals emanate from the plurality of output apertures at substantially the same time to form a substantially coherent combined sound signal that is expanded relative to front face 945 of waveguide 900.

According to one embodiment, isolated sound paths $915_{1-n}$ of waveguide 900 include similar curved paths for pairs of the isolated paths. For example, a first pair of isolated sound paths, such as $915_1$ and $915_n$, may be associated with a first curvature relative to a median of the waveguide structure. In addition, a second or other pair of isolated sound paths, such as $915_2$ and $915_3$, may be associated with a second curvature relative to a median of waveguide 900.

Figure 10:
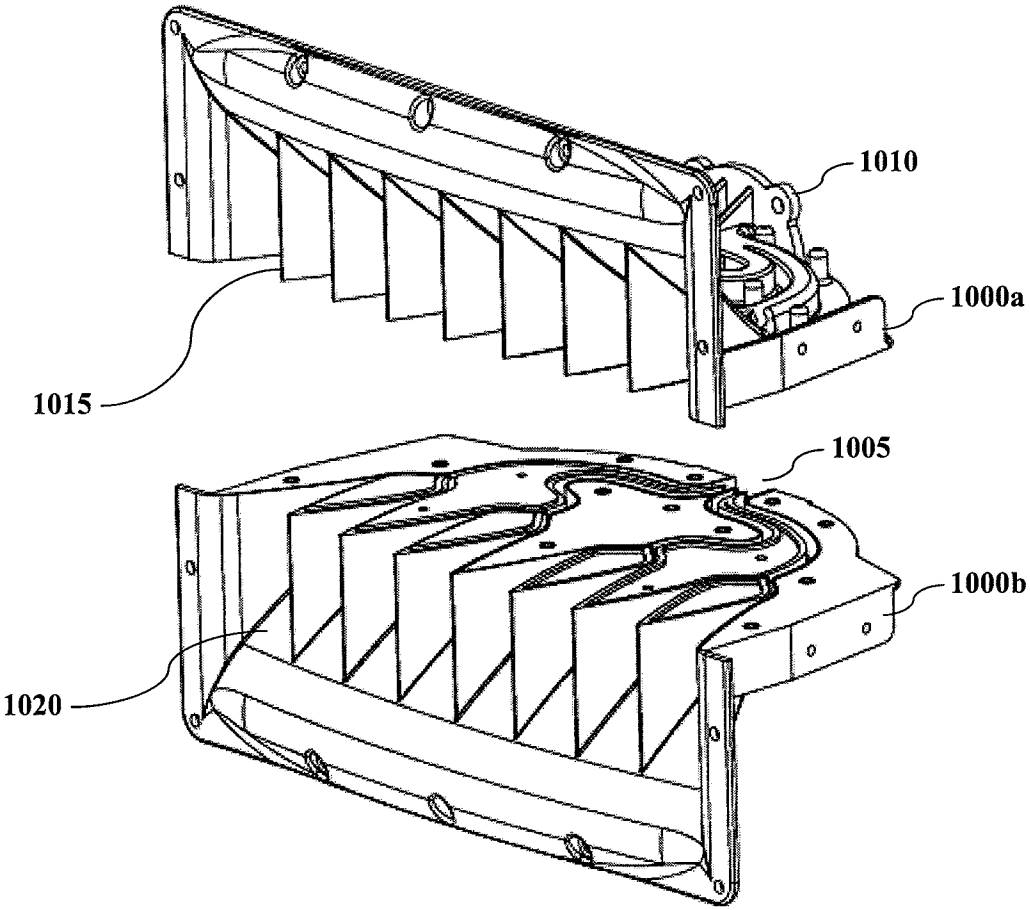
FIG. 10 depicts a graphical representation of a waveguide according to one or more embodiments.

Referring now to FIG. 10, a speaker assembly is depicted according to one or more embodiments. According to one embodiment, a speaker assembly may include a multi-piece assembly, wherein the speaker assembly may form a waveguide structure. As depicted in FIG. 10, the speaker assembly includes upper housing 1000*a* and lower housing 1000*b*. Upper and lower housings 1000*a* and 1000*b* may be coupled together to form isolated sound paths of a waveguide. The housings may be coupled to form sound paths that are airtight and sealed in a manner to provide one or more acoustic sound paths. As depicted in FIG. 10, input aperture 1005 of the waveguide may be configured to receive a sound signal from a driver. A driver mounting location on the rear of the waveguide structure is depicted as 1010.

The speaker assembly of FIG. 10 is depicted as being split relative to cross-sectional line A-A of FIG. 8. According to one embodiment, the speaker assembly may be formed from two housings split to form the upper and lower halves of a waveguide. Exit apertures of the speaker assembly may be formed by an upper portion, shown as 1015, and a lower portion, shown as 1020, associated with upper housing 1005*a* and lower housing 1005*b*, respectively. In certain embodiments, the speaker assembly may relate to housing formed of a single element.

Figure 11:
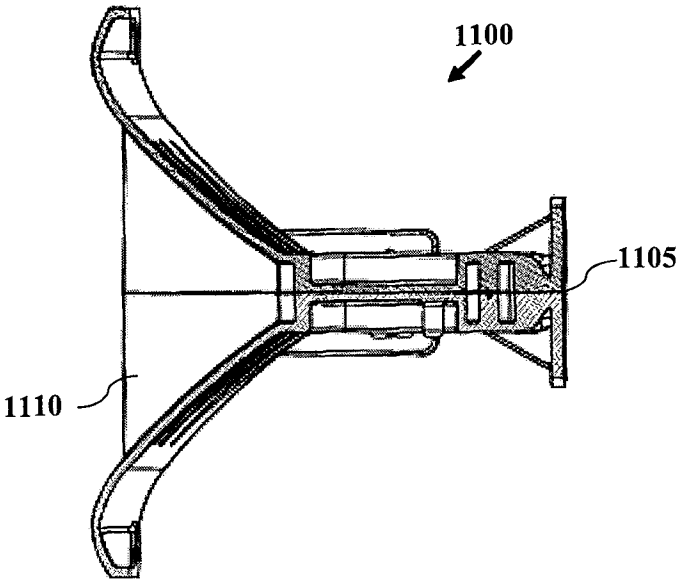
FIG. 11 depicts a revealed view of a speaker assembly according to one or more embodiments.

Referring now to FIG. 11, a revealed view of a speaker assembly is depicted according to one or more embodiments. The cut-away view depicted in FIG. 11 may relate to the waveguide of FIG. 9 taken along the line C-C. Waveguide 1100 includes input aperture 1105 which may be configured to receive sound signals. A side view is depicted of expanded opening 1110.

The angle of expanded opening 1110 of waveguide 1100 may be formed such that each of a plurality of sound signals output from waveguide 1100 may be combined to form a substantially coherent sound signal and facilitate coherent combination with sound signals emanating from adjacent sound sources. The angle of the expanded opening and the corresponding length of the sound signal for waveguide 1100 may be selected such that the curvature $\delta$ of the sound signal emanating therefrom is less than a quarter of the wavelength of the sound signal. The curvature $\delta=(L/2)\tan(\phi/2)$ where L corresponds to the length of the sound signal and $\phi$ is the angle of the expanded opening. In one embodiment, waveguide 1100 may include a horizontal angle attached to the plurality of expanded openings, thereby controlling the horizontal dispersion of the emanating sound signals.

In certain audio applications, it may be desirable to have the length dimension of the exit aperture of waveguide 1100 conform to a selected value. For example, a plurality of speaker assemblies may form one or more vertical arrays, where each vertical array comprises either low frequency, mid-range, or high-frequency speakers (or horns extending therefrom). In one such configuration, a vertical stack of high-frequency speaker assemblies may be interposed between two vertical stacks of bass speakers.

Figure 12:
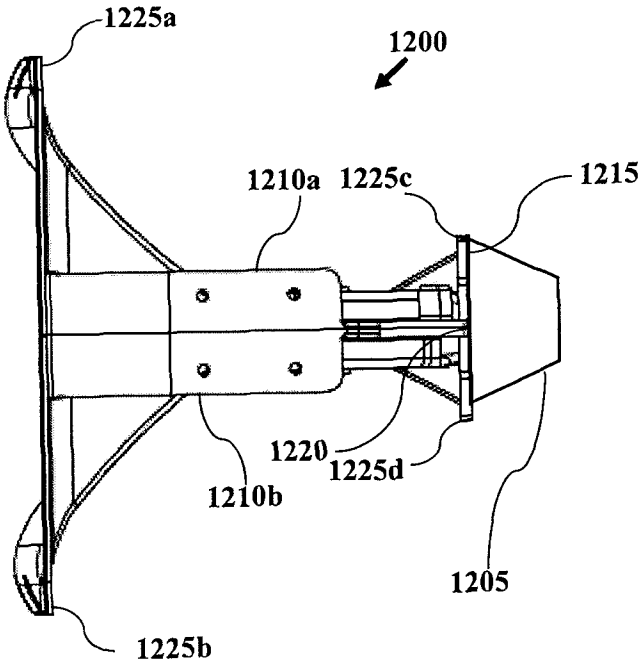
FIG. 12 depicts a side view of a speaker assembly according to one or more embodiments.

Referring now to FIG. 12, a side view of the speaker assembly of FIG. 8 is depicted according to one or more embodiments. As depicted in FIG. 12, speaker assembly 1200 includes driver 1205 and a waveguide structure formed by upper and lower housings 1210*a* and 1210*b*. The housing of speaker assembly 1200 may include mounting location 1215 for driver 1205. Driver 1205 may be mounted to a housing of the speaker assembly to output sound waves to input aperture 1220. Upper and lower housings 1210*a* and 1210*b* of the speaker assembly 1200 may be a single housing in certain embodiments.

The shape of speaker assembly 1200 may cause sound wavefronts of waves emitted from driver 1205 to generally become rounded, and thereby causing the directionality of the sound waves to spread out. For generally plane waves output by driver 1205, the wavefronts may become rounded due to a tendency of wavefronts to be orthogonal to boundaries of the sound paths. The degree of rounding of the wavefronts may generally depend on the taper angle of the sound path.

Speaker assembly 1200 may additionally include a plurality of mounting locations, shown as 1225*a*-1225*d*, to allow for speaker assembly 1200 to be mounted in an array and/or hung with one or more speaker assemblies. In one embodiment, speaker assemblies may be arranged along a vertical direction. Two or more speaker assemblies may be stacked vertically. The manner in which sound waves combine may depend on factors such as the frequency of the sound waves, dimension of the exit aperture, and the pitch of the taper. For audio applications, a generally accepted rule is that a curvature of the rounded wavefront needs to be less than approximately ¼ of the wavelength $\lambda$ of the sound wave.

Although the embodiments have been described with reference to preferred embodiments and specific examples, it will be readily appreciated by those skilled in the art that many modifications and adaptations of the waveguide and speaker assemblies described herein are possible without departure from the spirit and scope of the embodiments as claimed hereinafter. Thus, it is to be clearly understood that this description is made only by way of example and not as a limitation on the scope of the embodiments as claimed below.

What is claimed is:

1. A waveguide, comprising:

an input aperture configured to receive a sound signal from a sound source;

a plurality of isolated sound paths having substantially equal path lengths, each isolated sound path formed within a housing of the waveguide and configured to receive the sound signal from the input aperture such that the sound signal is divided into a plurality of sound signals, wherein each isolated sound path is formed with a curved path to reduce the depth of the waveguide; and a plurality of plugs, wherein each plug divides an output of one of the isolated sound paths into a plurality of output sound paths and defines a plurality of output apertures of the waveguide, and wherein each output sound path is characterized by a reduced width relative to the output of the isolated sound path, the plurality of output apertures configured to output a combined sound signal based, at least in part, on the plurality of sound signals.

2. The waveguide of claim 1, wherein the input aperture is configured to receive the sound signal from a driver.

3. The waveguide of claim 1, wherein an isolated sound path relates to a continuous structure for guiding sound waves from the input aperture to an output of an isolated sound path.

4. The waveguide of claim 1, wherein each isolated sound path is characterized by a one of a cylindrical or uniform shape one-quarter of the input aperture size.

5. The waveguide of claim 1, wherein the isolated sound paths are formed by upper and lower housings of the waveguide.

6. The waveguide of claim 5, wherein channels in the housing form the isolated sound paths.

7. The waveguide of claim 1, wherein equal path lengths of the isolated paths direct sound signals to the plurality of plugs in a substantially similar amount of time.

8. The waveguide of claim 1, wherein each isolated sound path is curved within a plane.

9. The waveguide of claim 1, wherein each plug is biased with a first end and second end, wherein the maximum width of the plug defines output sound paths.

10. The waveguide of claim 1, wherein each output path relates to a cylindrical path one-half of the dimension of an isolated sound path.

11. The waveguide of claim 1, wherein the waveguide is characterized by one of a linear and curvilinear front face, the output distributed by the output apertures based on the front face of the waveguide.

12. The waveguide of claim 1, wherein a plurality of sound signals emanate from the plurality of output apertures at substantially the same time to form a substantially coherent combined sound signal that is expanded relative to the front face of the waveguide.

13. The waveguide of claim 1, wherein the isolated sound paths of the waveguide include similar curved paths for pairs of the isolated paths, wherein a first pair are associated with a first curvature, and a second pair are associated with a second curvature.

14. A speaker assembly, comprising:

a sound source that produces a sound signal;

an input aperture configured to receive the sound signal from the sound source;

a plurality of isolated sound paths having substantially equal path lengths, each isolated sound path formed within a housing of the waveguide and configured to receive the sound signal from the input aperture such that the sound signal is divided into a plurality of sound signals, wherein each isolated sound path is formed with a curved path to reduce the depth of the waveguide; and a plurality of plugs, wherein each plug divides an output of one of the isolated sound paths into a plurality of output sound paths and defines a plurality of output apertures of the waveguide, and wherein each output sound path is characterized by a reduced width relative to the output of the isolated sound path, the plurality of output apertures configured to output a combined sound signal based, at least in part, on the plurality of sound signals.

15. The speaker assembly of claim 14, wherein the input aperture is configured to receive the sound signal from a driver.

16. The speaker assembly of claim 14, wherein an isolated sound path relates to a continuous structure for guiding sound waves from the input aperture to an output of an isolated sound path.

17. The speaker assembly of claim 14, wherein each isolated sound path is characterized by a one of a cylindrical or uniform shape one-quarter of the input aperture size.

18. The speaker assembly of claim 14, wherein the isolated sound paths are formed by upper and lower housings of the waveguide.

19. The speaker assembly of claim 18, wherein channels in the housing form the isolated sound paths.

20. The speaker assembly of claim 14, wherein equal path lengths of the isolated paths direct sound signals to the plurality of plugs in a substantially similar amount of time.

21. The speaker assembly of claim 14, wherein each isolated sound path is curved within a plane.

22. The speaker assembly of claim 14, wherein each plug is biased with a first end and second end, wherein the maximum width of the plug defines output sound paths.

23. The speaker assembly of claim 14, wherein each output path relates to a cylindrical path one-half of the dimension of an isolated sound path.

24. The speaker assembly of claim 14, wherein the waveguide is characterized by one of a linear and curvilinear front face, the output distributed by the output apertures based on the front face of the waveguide.

25. The speaker assembly of claim 14, wherein a plurality of sound signals emanate from the plurality of output apertures at substantially the same time to form a substantially coherent combined sound signal that is expanded relative to the front face of the waveguide.

26. The speaker assembly of claim 14, wherein the isolated sound paths of the waveguide include similar curved paths for pairs of the isolated paths, wherein a first pair are associated with a first curvature, and a second pair are associated with a second curvature.

* * * * *